US007829850B2

(12) United States Patent
Kovtoun

(10) Patent No.: US 7,829,850 B2
(45) **Date of Patent: *Nov. 9, 2010**

(54) BRANCHED RADIO FREQUENCY MULTIPOLE

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 139 days.

This patent is subject to a terminal disclaimer.

(21) Appl. No.: 12/198,043

(22) Filed: Aug. 25, 2008

(65) Prior Publication Data

US 2008/0315086 A1 Dec. 25, 2008

Related U.S. Application Data

(63) Continuation-in-part of application No. 11/373,354, filed on Mar. 9, 2006, now Pat. No. 7,420,161.

(51) Int. Cl.
*H01J 49/00* (2006.01)

(52) U.S. Cl. ..... 250/290; 250/281; 250/282; 250/288; 250/292; 250/293

(58) Field of Classification Search ..... None
See application file for complete search history.

(56) References Cited

U.S. PATENT DOCUMENTS

| | | | | |
|---|---|---|---|---|
| 5,468,958 | A * | 11/1995 | Franzen et al. | 250/292 |
| 5,625,186 | A * | 4/1997 | Frankevich et al. | 250/292 |
| 6,515,279 | B1 * | 2/2003 | Baykut | 250/285 |
| 6,891,157 | B2 * | 5/2005 | Bateman et al. | 250/292 |
| 7,420,161 | B2 * | 9/2008 | Kovtoun | 250/293 |

FOREIGN PATENT DOCUMENTS

| | | |
|---|---|---|
| WO | WO 2005/067000 A2 | 7/2005 |
| WO | WO 2007/030923 A1 | 3/2007 |

* cited by examiner

*Primary Examiner*—David A Vanore
(74) *Attorney, Agent, or Firm*—Charles B. Katz

(57) ABSTRACT

Systems and methods of the invention include a branched radio frequency multipole configured to act, for example, as an ion guide. The branched radio frequency multipole comprises multiple ion channels through which ions can be alternatively directed. The branched radio frequency multipole is configured to control which of the multiple ion channels ions are directed, through the application of appropriate potentials.

7 Claims, 8 Drawing Sheets

BRANCHED RADIO FREQUENCY MULTIPOLE

CROSS-REFERENCE TO RELATED APPLICATION

This application is a continuation-in-part of U.S. patent application Ser. No. 11/373,354 now U.S. Pat. No. 7,420,161 entitled "Branched Radio Frequency Multipole" and filed on Mar. 9, 2006, the entire disclosure of which is incorporated herein by reference.

BACKGROUND OF THE INVENTION

1. Field of the Invention

The invention is in the field of ion optics.

2. Description of Related Art

Ion guides comprising four electrodes are used to transport ions from one place to another. For example, in mass spectrometry ion guides may be used to transport ions from an ion source to an ion analyzer. Some types of ion guides operate using radio frequency potentials applied to the four electrodes. Neighboring electrodes (orthogonal to each other) in the ion guide are operated at potentials of opposite polarity, while opposing electrodes in the ion guide are operated at the same potentials. The use of appropriate potentials results in the generation of a quadrupole field and an ion channel through which ions will preferentially travel. In some instances, such ion guides also operate as a mass filter or collision cell.

SUMMARY OF THE INVENTION

Roughly described, a branched multipole structure constructed in accordance with an embodiment of the invention has a plurality of electrodes arranged in pairs opposed across an ion flow axis. The electrodes define first and second ion channels, which have a shared or common portion and a divergent portion. An RF voltage source applies RF voltages to at least a portion of the plurality of electrodes to establish RF fields that radially confine ions within the ion channels. By adjusting the phase and/or magnitude of the RF voltages applied to one or more electrodes, the ions are caused to preferentially travel along the first or second ion channel. In some implementations, a DC axial field may be established along at least a portion of the first and/or second ion channels to assist in transporting ions through the multipole structure and thereby improve transmission efficiency.

DETAILED DESCRIPTION

The invention comprises a branched radio frequency multipole for guiding ions from a source toward alternative ion destinations, or from a plurality of ion sources to an ion destination. The invention may comprise two ion destinations or two ion sources. The branched radio frequency multipole comprises electrodes divided into segments, and is configured to guide ions through different ion channels by applying different radio frequency (RF) voltages to these segments.

Figure 1:
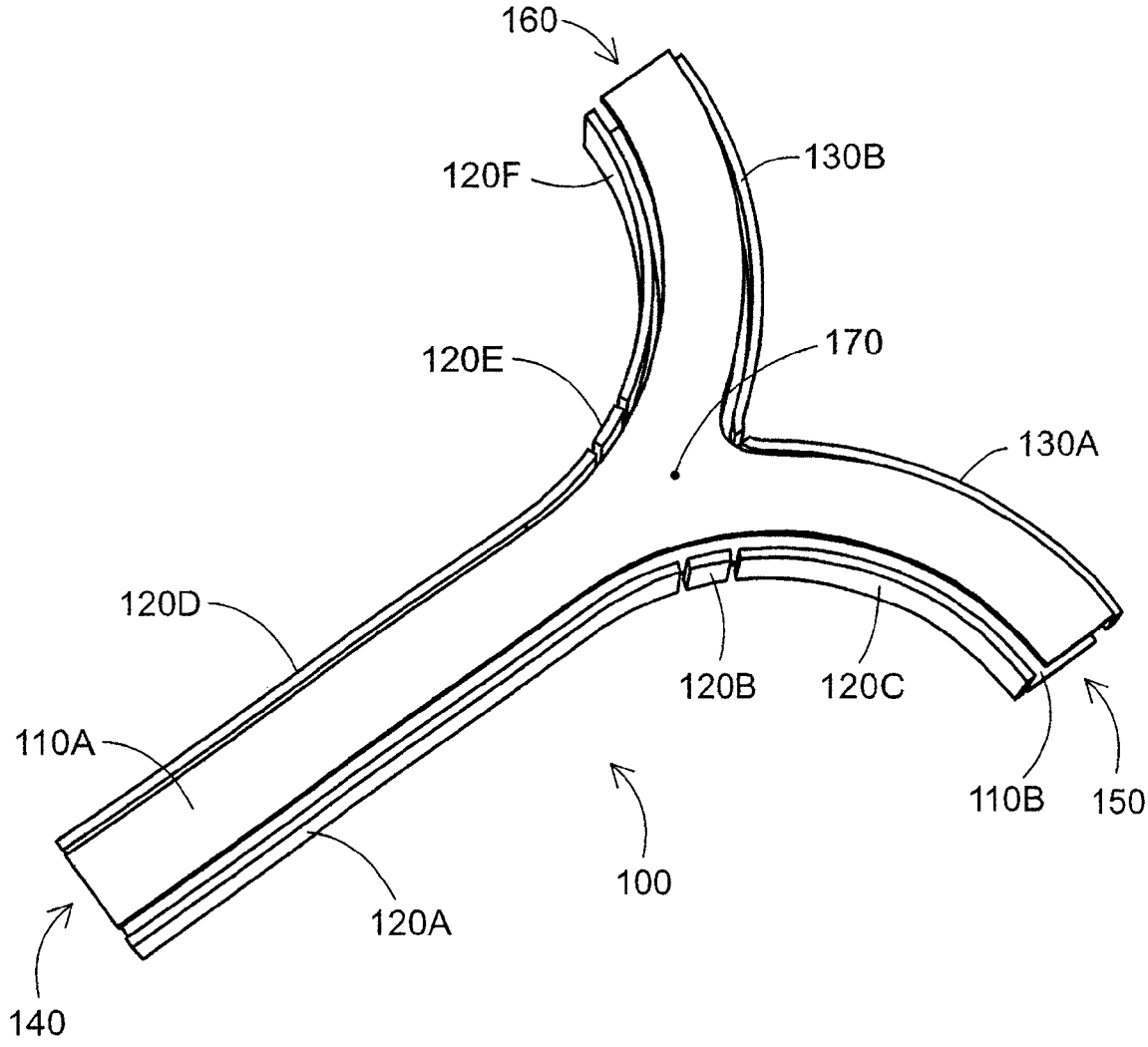
FIG. 1 illustrates a perspective view of a branched radio frequency multipole system, according to various embodiments of the invention.

FIG. 1 illustrates a perspective view of a branched radio frequency multipole system, according to various embodiments of the invention. Branched radio frequency multipole system 100 comprises branched electrodes 110*a* and 110*b*, disposed parallel to each other. Branched radio frequency multipole system also comprises orthogonal electrodes 120A, 120B, 120C, 120D, 120E, 120F, 130A, and 130B. The orthogonal electrodes 120A-120F, 130A, and 130B are disposed orthogonally to the branched electrodes 110A and 110B such that the branched radio frequency multipole 100 comprises a first ion channel between ports 140 and 150 and a second ion channel between ports 140 and 160 of branched radio frequency multipole 100. Port 140 is an opening defined by the branched electrodes 110A and 110B and the orthogonal electrodes 120A and 120D. Port 150 is an opening defined by the branched electrodes 110A and 110B and the orthogonal electrodes 120C and 130A. Port 160 is an opening defined by the branched electrodes 110A and 110B and the orthogonal electrodes 120F and 130B. The first ion channel and the second ion channel overlap in part of the branched radio frequency multipole 100 adjacent to port 140 and diverge at a branch point 170 before continuing to port 150 and port 160, respectively.

The RF voltages applied to orthogonal electrodes 120B, 120C and 130A may be controlled such that the first ion channel comprising a path between port 140 and port 150 is opened. Alternatively, the RF voltages applied to orthogonal electrodes 120E, 120F, and 130B may be controlled such that the second ion channel comprising a path between port 140 and port 160 is opened. Thus, the paths by which ions traverse branched radio frequency multipole 100 can be controlled by the selection of appropriate voltages.

Figure 2:
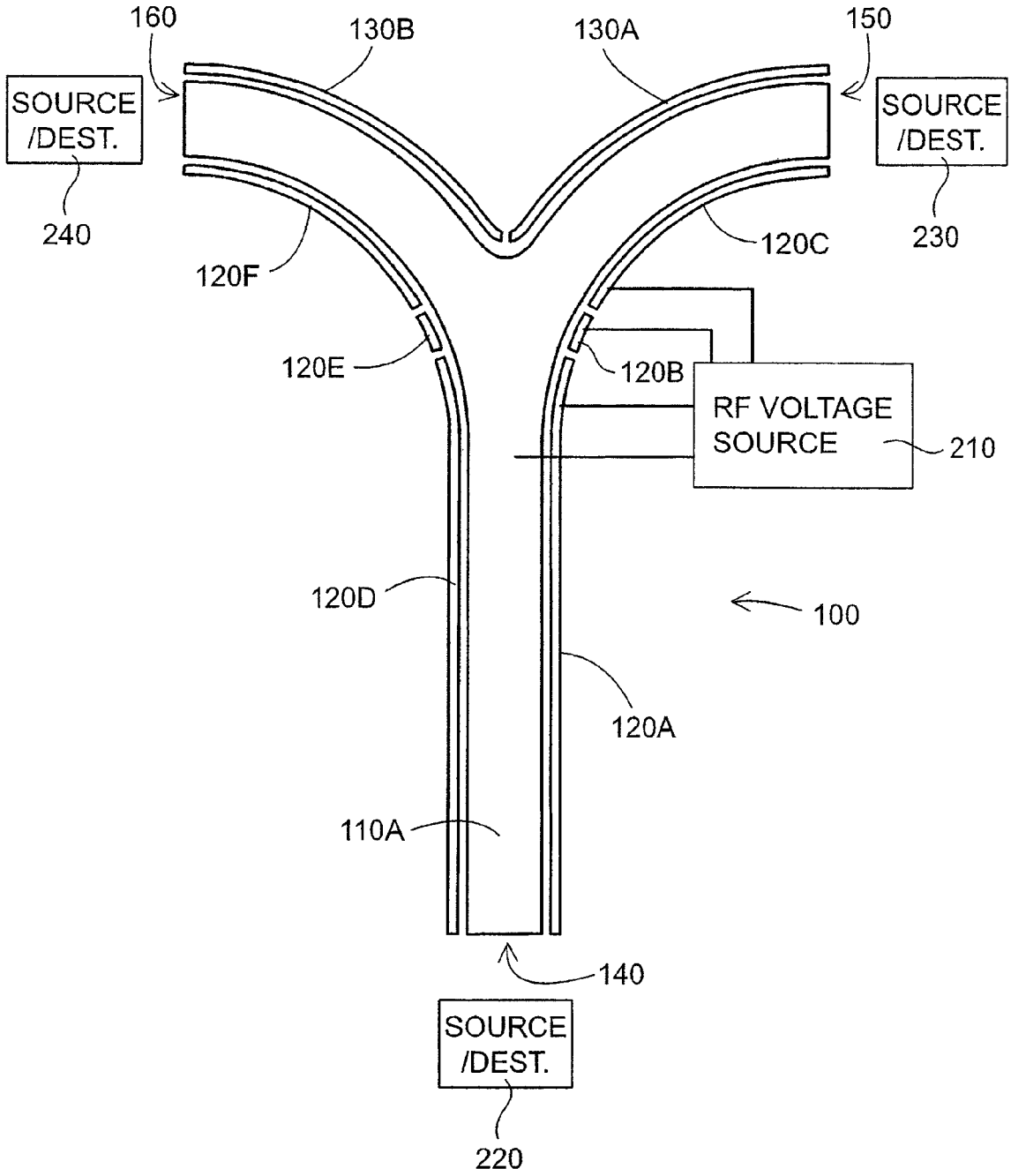
FIG. 2 illustrates a top view of the branched radio frequency multipole system of FIG. 1, having orthogonal electrodes split into segments, according to various embodiments of the invention.

FIG. 2 illustrates a top view of the branched radio frequency multipole system 100 of FIG. 1, having orthogonal electrodes split into segments, according to various embodiments of the invention. The branched radio frequency multipole system 100 also comprises a radio frequency voltage source 210. Radio frequency voltage source 210 may be coupled to the orthogonal electrodes 120A, 120B, 120C, 120D, 120E, 120F, 130A, and 130B. Several, but not all, of these connections are shown in FIG. 2. Radio frequency voltage source 210 may also be coupled to the branched electrodes, e.g. 110A and 110B.

The RF voltages applied to orthogonal electrodes 120A-120F, 130A, 130B, and branched electrodes 110A and 110B may be controlled such that the first ion channel comprising a path between port 140 and port 150 is opened. For example, the RF voltages applied to orthogonal electrodes 120A-120F, 130A and 130B may be controlled such that the RF voltage on orthogonal electrode 120E-120F and 130B is at least 1.1, 1.5, 2, or 3 times the RF voltage on orthogonal electrodes 120A-120D and 130A. Alternatively, the RF voltages applied to orthogonal electrodes 120A-120F, 130A, 130B and branched electrodes 110A and 110B may be controlled such that the second ion channel comprising a path between port 140 and port 160 is opened. For example, the RF voltages on orthogonal electrodes 120A-120F, 130A and 130B may be controlled such that the RF voltage on orthogonal electrode 120B-120C and 130A is at least 1.1, 1.5, 2, or 3 e times the RF voltage on orthogonal electrodes 120A, 120D-120F and 130B.

The branched radio frequency multipole system 100 also comprises optional ion source/destinations 220, 230, and 240. Ion source/destination 220, ion source/destination 230, and ion source/destination 240 may each be an ion source and/or an ion destination. As ion sources they may comprise, for example, an electron impact (EI) ion source, an electrospray (ESI) ion source, a matrix-assisted laser desorption (MALDI) ion source, a plasma source, an atmospheric pressure chemical ionization (APCI) ion source, a laser desorption ionization (LDI) ion source, an inductively coupled plasma (ICP) ion source, a chemical ionization (CI) ion source, a fast atom bombardment (FAB) ion source, an electron source, a liquid secondary ions mass spectrometry (LSMIS) source, or the like. As ion destinations they may comprise, for example, a mass filter, a chemical analyzer, material to be treated by the ion, a time of flight (TOF) mass analyzer, a quadrupole mass analyzer, a Fourier transform ion cyclotron resonance (FTICR) mass analyzer, a 2D (linear) quadrupole, a 3d quadrupole ion trap, a magnetic sector mass analyzer, a spectroscopic detector, a photomultiplier, a ion detector, an ion reaction chamber, or the like.

Figure 3:
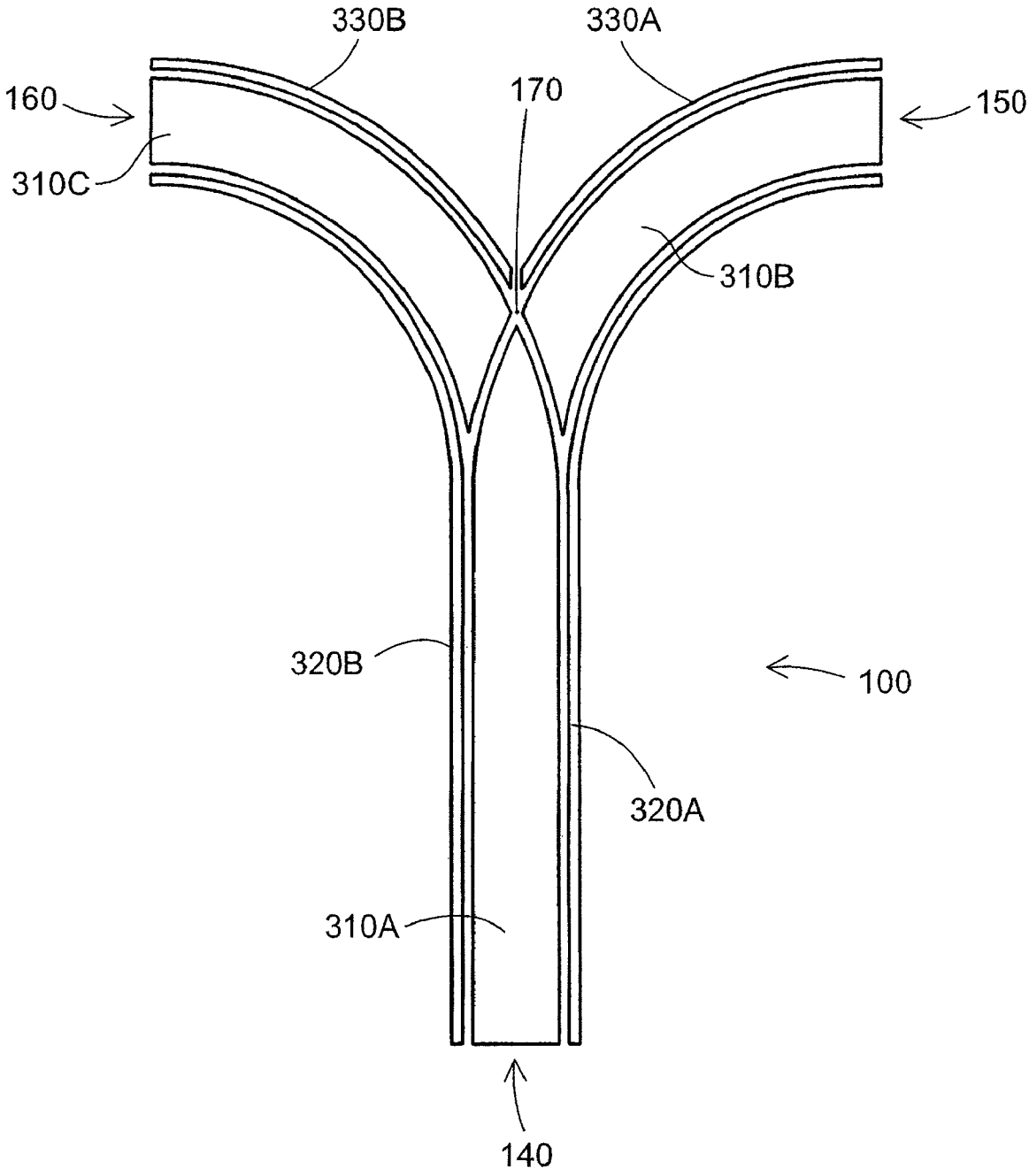
FIG. 3 illustrates a top view of a branched radio frequency multipole system, having branched electrodes split into segments, according to various embodiments of the invention.

FIG. 3 illustrates a top view of the branched radio frequency multipole system 100, wherein branched electrodes 110A and 110B are each split into segments, according to various embodiments of the invention. In these embodiments, branched electrode 110 and branched electrode 110B each include electrode segments 310A, 310B, and 310C. The electrode segments 310A, 310B, and 310C are disposed relative to each other such that a branched shape is formed. Branched radio frequency multipole system 100 also comprises orthogonal electrodes 320A, 320B, 330A, and 330B, disposed orthogonally to electrode segments 310A, 310B, and 310C.

RF voltages applied to electrode segment 310C and orthogonal electrodes 320A, 320B, 330A, and 330B may be controlled such that ions are directed through the first ion channel between port 140 and port 150. When an ion channel is open, those members of electrode segments 310A, 310B, and 310C that are adjacent to the open channel are normally operated at RF voltages having a polarity opposite of an RF voltage applied to the orthogonal electrodes 320A, 320B, 330A and 330B. When part of an ion channel is closed, this relationship between electrode segments of the branched electrodes and the orthogonal electrodes is not maintained, e.g. the same potentials may be applied to both a segment of the branched electrodes and the orthogonal electrodes.

For example, the RF voltage applied to electrode segment 310C may be to the same as the RF voltages applied to orthogonal electrodes 320A, 320B, 330A, and 330B. Setting the same potential on all four electrodes forming a branch of an ion channel allows the ion guide to reproduce an electric potential distribution closely analogous to a theoretical electric potential distribution if electrode segment 330A were continued following its curvature until it merged into electrode segment 320B. This configuration would be effectively equivalent, in terms of electric field distribution and ion transfer, to a regular curved four-electrode set. In this case, ions will successfully be passed through the first ion channel between port 140 and port 150, but will not traverse between port 160 and port 140. Alternatively, the RF voltages applied to electrode segment 310B and orthogonal electrodes 320A, 320B, 330A, and 330B may be the same. In this case, ions are directed through the second ion channel between port 140 and port 160 and will not successfully pass between port 140 and port 150.

Figure 4A:
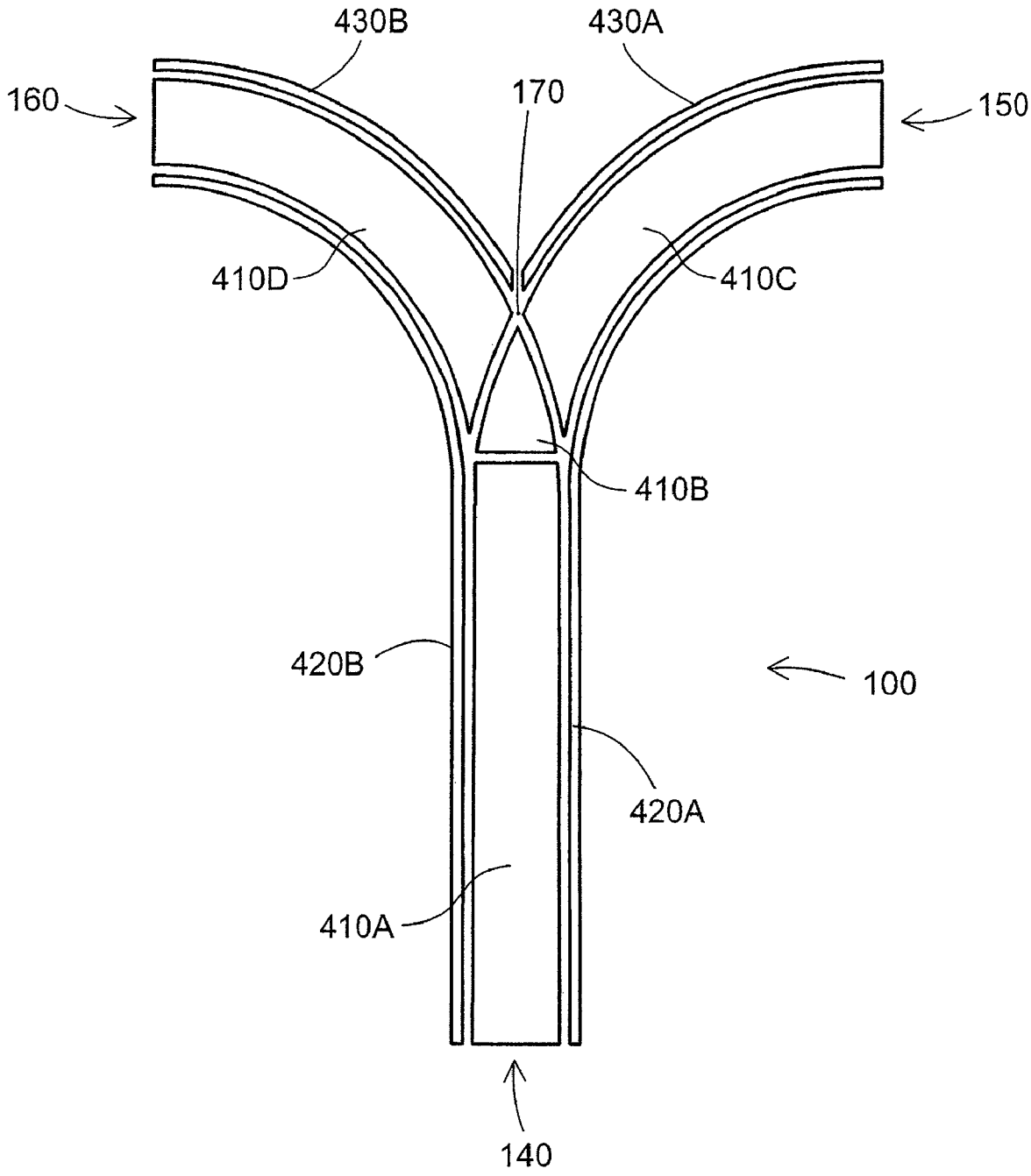
FIG. 4A illustrates a top view of a branched radio frequency multipole system, having a branched electrode split into segments, according to various embodiments of the invention.

FIG. 4A illustrates a top view of the branched radio frequency multipole system 100, wherein the branched electrodes 110A and 110B are each split into segments, according to various embodiments of the invention. The branched electrode 110A is split into segments 410A, 410B, 410C, and 410D, which are disposed relative to each other such that a branched shape is formed. Orthogonal electrodes 420A, 420B, 430A, and 430B are disposed orthogonally to the electrode segments 410A, 410B, 410C, and 410D.

In a manner similar to that described in FIG. 3, RF voltages may be applied to electrode segments 410A, 410B, 410C, 410D and orthogonal electrodes 420A, 420B, 430A and 430B in order to open the first ion channel between port 140 and port 150, or alternatively, the second ion channel between port 140 and port 160. Electrode segment 410B is typically maintained at the same RF voltages as electrode segment 410A.

Figure 4B:
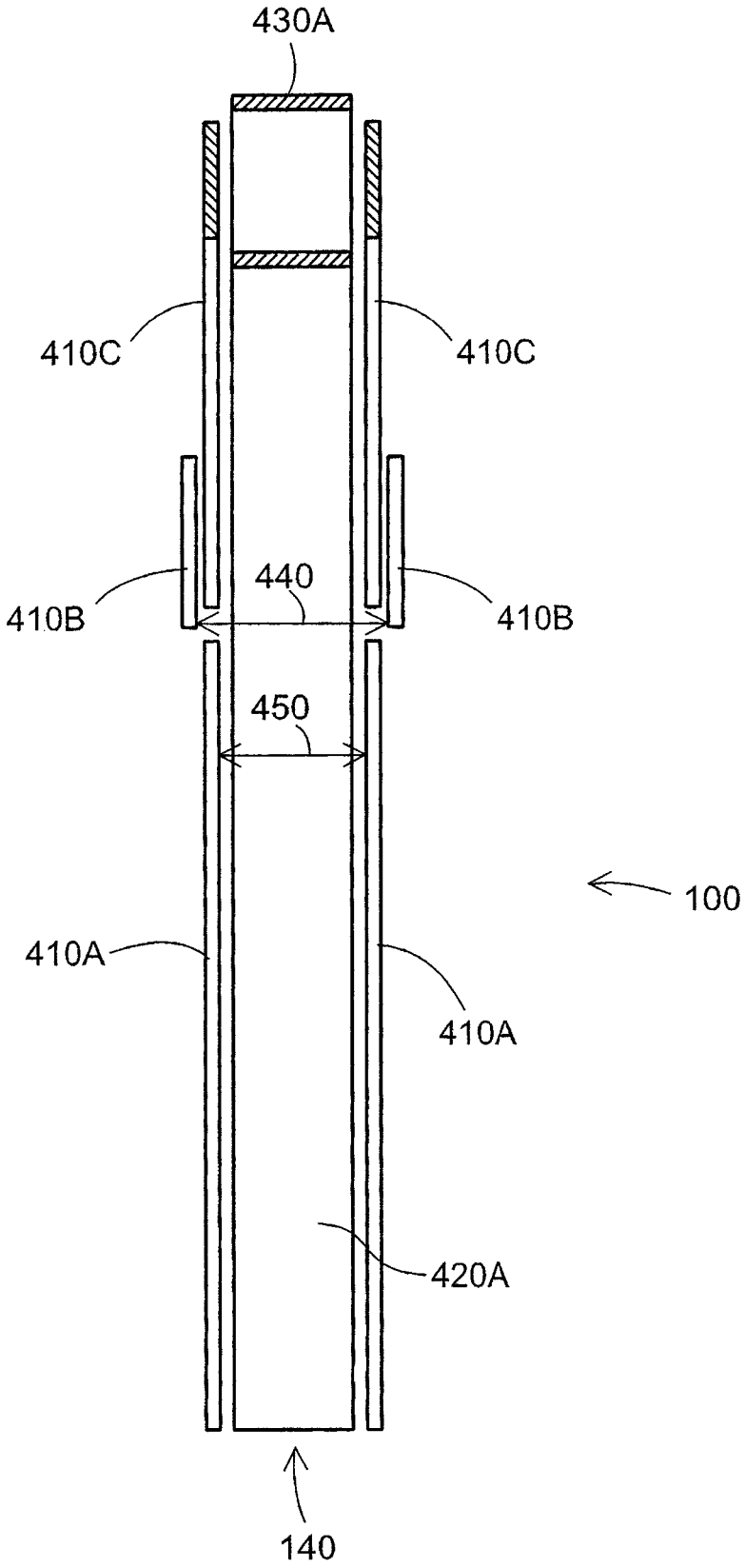
FIG. 4B illustrates a side view of the branched radio frequency multipole system of FIG. 4A, according to various embodiments of the invention.

FIG. 4B illustrates a side view of the branched radio frequency multipole system 100 of FIG. 4A, according to various embodiments of the invention. This view shows that electrode segment 410B is displaced relative to electrode segment 410A. Specifically, an inter-electrode distance 440 between the two instances of electrode segment 410B that make up part of branched electrode 110A and 110B (FIG. 1) is greater than an inter-electrode distance 450 between the two instances of electrode segment 410A that make up part of branched electrode 110A and 110B. In various embodiments, the inter-electrode distance 440 differs from the inter-electrode distance 450 by greater than 4, 8, 12 or 15 percent of inter-electrode distance 450. In some instances, the embodiments of branched radio frequency multipole 100 illustrated by FIGS. 4A and 4B provide a greater control of the opening and closing of ion channels than the embodiments illustrated by FIG. 3. For example, the embodiments illustrated by FIGS. 4A and 4B allow for better shaping of the electric potential close to electrode 410B where the most significant distortion of electric field occurs because of electrode branching. This may result in better ion transmission efficiency in the open channel. In alternative embodiments, electrode segments 410A and 410B are a single piece shaped to achieve the inter-electrode distances 440 and 450.

Figure 5:
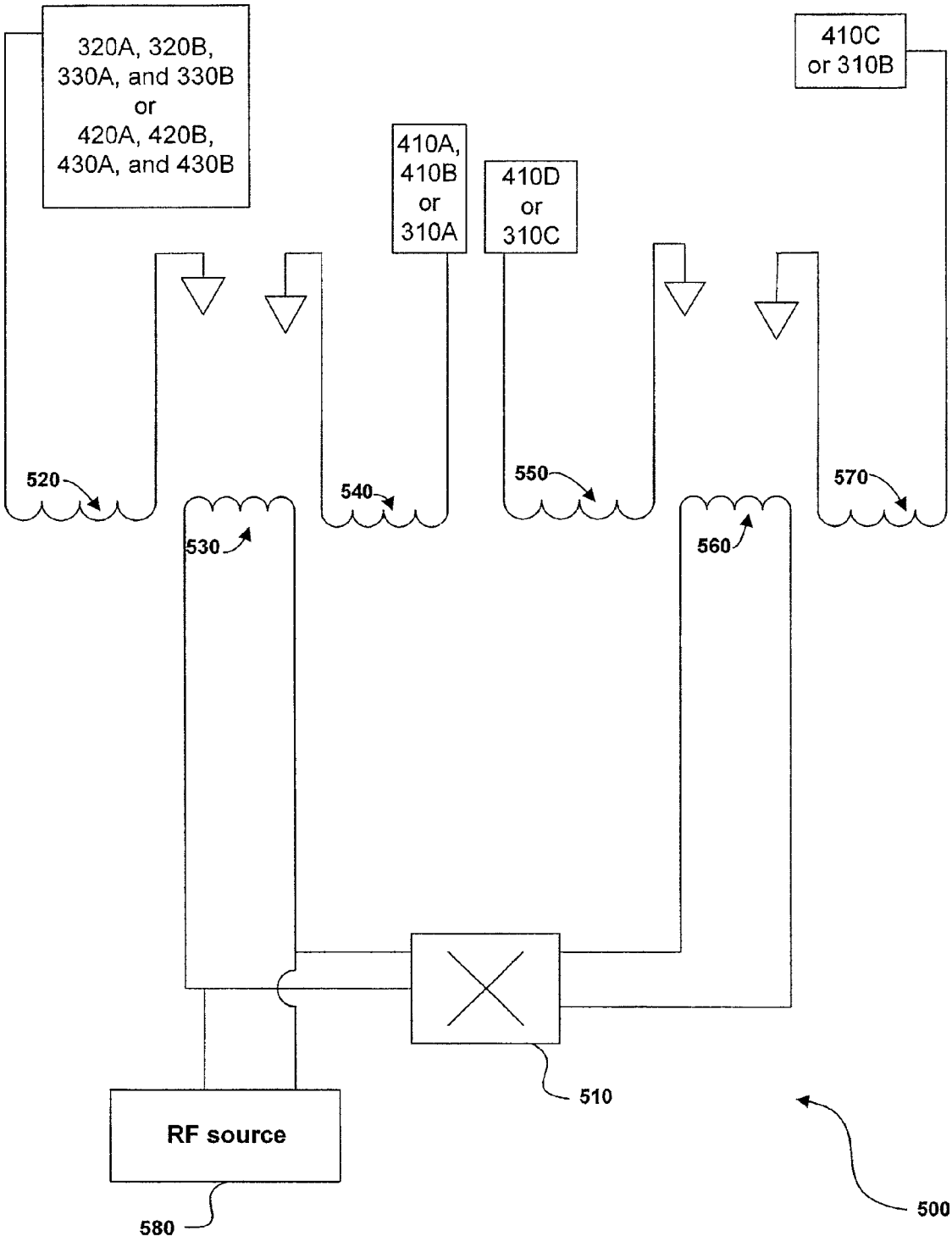
FIG. 5 is a diagram of a circuit configured to supply radio frequency potentials to a branched radio frequency multipole system, according to various embodiments of the invention.

FIG. 5 is a diagram of a circuit configured to supply radio frequency voltages to a branched radio frequency multipole system, according to various embodiments of the invention. Circuit 500 is optionally included in radio frequency voltage source 210. Circuit 500 comprises a phase switch 510, inductors 520, 530, 540, 550, 560, and 570, and an RF source 580. The phase of RF voltages on inductors 530 and 560 are dependent on the state of the phase switch 510. When phase switch 510 is OFF, both of these inductors will have the same RF voltages. When phase switch 510 is ON, inductors 530 and 560 will have RF voltages of opposite polarity, e.g. be 180 degrees out of phase with each other. Inductors 520 and 540 respond to the inductance on inductor 530. Inductors 550 and 570 respond to the inductance on inductor 560. Thus, depending on whether the phase switch is on or off, one of 410D (or 310C) and 410C (or 310B) will have the same polarity as 410A, 410B, while the other will have the opposite polarity. Ion channels will be opened and closed accordingly. With this circuit 500, turning on and off the phase switch 510 can be used to open and close ion channels in the branched radio frequency multipole 100.

Figure 6:
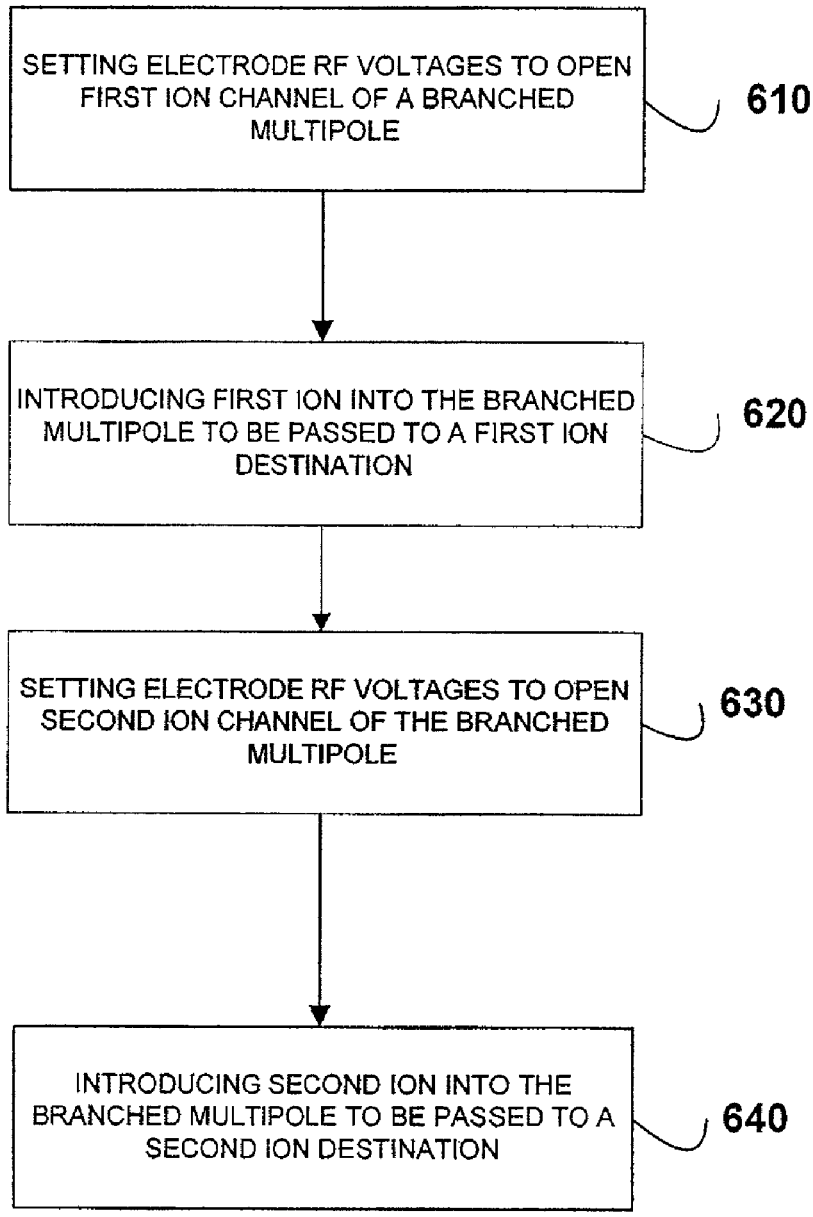
FIG. 6 is a flowchart illustrating a method, according to various embodiments of the invention.

FIG. 6 is a flowchart illustrating a method, according to various embodiments of the invention. In this method, electrode RF voltages are adjusted to alternatively pass ions to different destinations. A step 610 comprises setting electrode RF voltages such that the first ion channel between ports 140 and 150 of the branched radio frequency multipole 100 is opened to allow a first ion from an ion source, e.g. ion source/destination 220, to pass through the first ion channel toward a first ion destination, e.g. ion source/destination 230. A step 620 comprises introducing the first ion into the branched radio frequency multipole 100 and passing the first ion to the first ion destination. A step 630 comprises setting electrode RF voltages such that the second ion channel between ports 140 and 160 of the branched radio frequency multipole 100 is opened to allow a first ion from an ion source, e.g. ion source/destination 220, to pass through the first ion channel toward a second ion destination, e.g. ion source/destination 240. A step 640 comprises introducing the second ion into the branched radio frequency multipole 100 and passing the second ion to the second ion destination.

Figure 7:
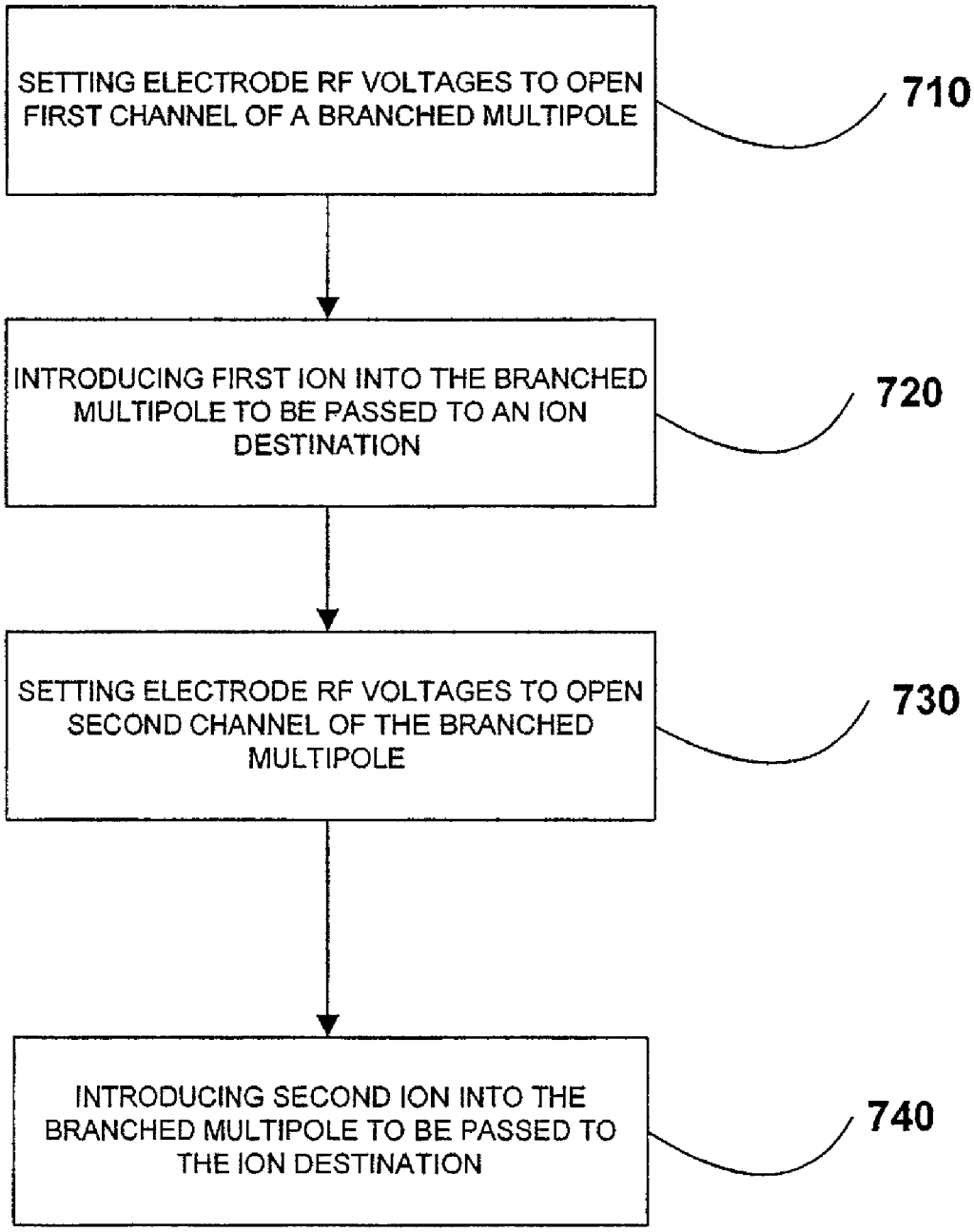
FIG. 7 is a flowchart illustrating an alternative method, according to various embodiments of the invention.

FIG. 7 is a flowchart illustrating a method, according to various embodiments of the invention. In this method, electrode RF voltages are adjusted to alternatively pass ions to different destinations. A step 710 comprises setting electrode RF voltages such that the first ion channel between ports 140 and 150 of the branched radio frequency multipole 100 is opened to allow a first ion from a first ion source, e.g. ion source/destination 230, to pass through the first ion channel toward an ion destination, e.g. ion source/destination 220. A step 720 comprises introducing the first ion into the branched radio frequency multipole 100 and passing the first ion to the ion destination. A step 730 comprises setting electrode RF voltages such that the second ion channel between ports 140 and 160 of the branched radio frequency multipole 100 is opened to allow a first ion from a second ion source, e.g. ion source/destination 240, to pass through the first ion channel toward the ion destination, e.g. ion source/destination 220. A step 740 comprises introducing the second ion into the branched radio frequency multipole 100 and passing the second ion to the ion destination.

Several embodiments are specifically illustrated and/or described herein. However, it will be appreciated that modifications and variations are covered by the above teachings and within the scope of the appended claims without departing from the spirit and intended scope thereof. For example, while the embodiments described above and depicted in the figures utilize electrodes of generally planar shape, the invention should not be construed as being limited thereto. Other embodiments may utilize electrodes having a square cross-section, or electrodes having an inwardly directed curved (e.g., round or hyperbolic) surface. In each case, the electrodes are arranged into at least two pairs, with each electrode being opposed across an ion flow axis to a corresponding electrode.

In certain implementations, the branched multipole structure may function as a collision/reaction cell to produce controlled dissociation of the entering ions, for example via collision induced dissociation. For such an implementation, a collision or reaction gas is added through a collision/reaction gas source (which may include a gas supply, metering valve and conduit) to at least a portion of the interior volume of the multipole structure. A set of plates or similar structures having conductance limiting apertures may be utilized to create a pressurized region within the multipole's interior volume. The addition of a collision or damping gas may also be utilized to provide collisional focusing of ions and thereby improve ion transmission efficiences through the multipole.

It may be beneficial to establish an axial (longitudinal) DC field along at least a portion of the first/and or second ion channels to assist in urging ions to travel along the ion flow axes. This may be particularly advantageous where the multipole is operated at a relatively high pressure, and the ion undergo large number of collisions with atoms/molecules of collision or background gas, thereby reducing the ions' kinetic energy. Techniques for establishing axial DC fields in RF multipoles are well known in the art, and are disclosed, for example, in U.S. Pat. No. 6,111,250 by Thomson et al. ("Quadrupole with Axial DC Field") and U.S. Pat. No. 7,067,802 by Kovtoun ("Generation of Combination of RF and Axial DC Electric Fields in an RF-Only Multipole"), the disclosures of which are incorporated herein by reference. Generally speaking, a DC voltage source is provided for applying DC voltages to DC axial field electrodes which extend or are spaced longitudinally along the first and/or second ion channels. The DC axial field electrodes may be external to or integrated with the multipole electrodes to which the RF voltages are applied. In certain implementations, the DC voltages applied to the axial field electrodes may be adjusted in accordance with the selection of the first or second ion channel as the preferred ion channel.

The embodiments discussed herein are illustrative of the present invention. As these embodiments of the present invention are described with reference to illustrations, various modifications or adaptations of the methods and/or specific structures described may become apparent to those skilled in the art. All such modifications, adaptations, or variations that rely upon the teachings of the present invention, and through which those teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A multipole structure for controllably guiding ions, comprising:

a plurality of electrodes defining a first and a second ion channel, a portion of the first and second ion channels being divergent, the electrodes being arranged into pairs wherein each of the plurality of electrodes is opposed across an ion flow axis to a corresponding electrode; and an RF voltage source for applying RF voltages to at least some of the electrodes of the plurality of electrodes, the RF voltage source being configured to controllably adjust at least one of the phase and the magnitude of an RF voltage applied to one or more electrodes to cause ions to preferentially travel along the first or the second ion channel.

2. The multipole structure of claim 1, further comprising a DC voltage source for applying DC voltages to axial field electrodes to establish an axial DC field along at least a portion of at least one of the first and second ion channels.

3. The multipole structure of claim 1, wherein the RF voltage source is configured to cause the ions to preferentially travel along the first or the second ion channel by increasing the magnitude of RF voltages applied to electrodes positioned adjacent to a divergent portion of the non-preferred ion channel.

4. The multipole structure of claim 1, wherein the RF voltage source is configured to cause the ions to preferentially travel along the first or the second ion channel by adjusting the phase of RF voltages applied to electrodes positioned adjacent to a divergent portion of the non-preferred ion channel, such that the RF voltages of the same phase are applied to corresponding electrodes of the first and second electrode extending along the non-preferred ion channel.

5. The multipole structure of claim 1, further comprising a collision/reaction gas source for adding collision/reaction gas to a least a portion of the interior volume of the multipole structure.

6. The multipole structure of claim 1, wherein the first and second ion channels are respectively coupled along separate ion paths to first and second ion sources.

7. The multipole structure of claim 1, wherein the first and second ion channels are respectively coupled along separate ion paths to first and second mass analyzers.

* * * * *